United States Patent [19]

Iding et al.

[11] Patent Number: 4,937,893

[45] Date of Patent: Jul. 3, 1990

[54] PASSIVE-DOSING DISPENSER EMPLOYING CAPTIVE INTERNALLY-GENERATED GAS BUBBLE TO PROVIDE PRODUCT ISOLATION

[75] Inventors: Stephen H. Iding; Robert S. Dirksing, both of Cincinnati, Ohio

[73] Assignee: The Procter & Gamble Company, Cincinnati, Ohio

[21] Appl. No.: 420,643

[22] Filed: Oct. 11, 1989

Related U.S. Application Data

[63] Continuation of Ser. No. 618,622, Jun. 8, 1984, abandoned.

[51] Int. Cl.[5] ..... E03D 9/03

[52] U.S. Cl. ..... 4/228

[58] Field of Search ..... 4/227, 228

[56] References Cited

U.S. PATENT DOCUMENTS

| | | | |
|---|---|---|---|
| 969,729 | 9/1910 | Smith | 4/228 |
| 3,353,538 | 11/1967 | Carrigan | 604/353 X |
| 3,721,243 | 3/1973 | Hesterman et al. | 604/353 X |
| 4,168,550 | 9/1979 | Lindauer | 4/228 |
| 4,171,546 | 10/1979 | Dirksing | 4/228 |
| 4,204,983 | 5/1980 | Swarthout et al. | 604/368 X |
| 4,208,747 | 6/1980 | Dirksing | 4/228 |
| 4,221,684 | 9/1980 | Antholz et al. | 604/368 X |
| 4,281,421 | 8/1981 | Nyquist et al. | 4/228 |
| 4,296,234 | 10/1981 | Mindt | 604/368 X |
| 4,438,534 | 3/1984 | Keyes et al. | 4/227 |
| 4,453,278 | 6/1984 | Doggett et al. | 4/228 |
| 4,459,710 | 7/1984 | Keyes et al. | 4/228 |
| 4,480,341 | 11/1984 | Richards | 4/228 |
| 4,485,500 | 12/1984 | Melville, Jr. | 4/228 |
| 4,530,118 | 7/1985 | Richards | 4/227 |

FOREIGN PATENT DOCUMENTS

| | | | |
|---|---|---|---|
| 82101353.9 | 8/1983 | European Pat. Off. . | |
| 80/00535 | 4/1980 | PCT Int'l Appl. | 604/349 |
| 2016929 | 9/1979 | United Kingdom | 604/353 |
| 2090884 | 5/1982 | United Kingdom | 4/227 |
| 2128647 | 5/1984 | United Kingdom | 4/227 |

OTHER PUBLICATIONS

Sani-Flush® Tank II TM, Circa 9/82, Boyle-Midway Inc.

Vanish® Bowl Brite®, Circa 11/83, The Drackett Co.

*Primary Examiner*—Charles E. Phillips

*Attorney, Agent, or Firm*—Thomas J. Slone; John V. Gorman; Richard C. Witte

[57] ABSTRACT

The present invention is a passive dosing dispenser for containing a solution which is to be isolated from a body of liquid when the dispenser is at least partially immersed therein. The dispenser is adapted to have a dose of the solution issue from the dispenser in response to the level of the body of liquid being lowered from a first elevation to a second elevation, and to have liquid taken into the dispenser as the level of the body of liquid rises from the second elevation to the first elevation. The dispenser has an internal reservoir which contains the solution, and an inlet/discharge passageway which, in use, provides fluid communication between the reservoir and the body of liquid. The inlet/discharge passageway has an intermediate, inverted, generally u-shaped section in which a gas-lock is formed to isolate the solution from the body of liquid. The dispenser contains a gas generating means for providing gas bubbles in the dispenser and passive means for directing at least a portion of the gas bubbles to the inverted, generally u-shaped section of the inlet/discharge passageway to establish a gas-lock thereacross.

15 Claims, 3 Drawing Sheets

PASSIVE-DOSING DISPENSER EMPLOYING CAPTIVE INTERNALLY-GENERATED GAS BUBBLE TO PROVIDE PRODUCT ISOLATION

This is a continuation of application Ser. No. 618,622, filed on June 8, 1984 now abandoned.

TECHNICAL FIELD

The present invention relates to dosing dispensers for products such as toilet tank additives, especially disinfectants. The present invention relates particularly to an entirely passive (no moving parts) dispenser in which a solid product gradually dissolves to form a solution, and from which dispenser a dose of such solution issues each time the toilet is flushed.

BACKGROUND OF THE INVENTION

Dosing dispensers of various geometries are disclosed in prior art patents; examples of such dispensers are disclosed in the following U.S. Patents: No. 634,515 issued to Wade on Oct. 10, 1899; No. 650,161 issued to J., W. H., & E. R. Williams on May 22, 1900; No. 969,729 issued to Smith on Sept. 6, 1910; No. 1,175,032 issued to E. R. Williams on Mar. 14, 1916; No. 1,144,525 issued to Blake on June 29, 1915; No. 2,812,119 issued to Bethune on Nov. 5, 1957; No. 2,839,763 issued to Newsom on June 24, 1958; No. 3,073,488 issued to Kompter on Jan. 15, 1963; No. 3,105,245 issued to Finkbiner on Oct. 1, 1963; No. 3,181,731 issued to Ellis on May 4, 1965; No. 3,339,801 issued to Hronas on Sept. 5, 1967; No. 3,407,412 issued to Spear on Oct. 29, 1968; No. 3,417,410 issued to Tietema & Rodak on Dec. 24, 1968; No. 3,781,926 issued to Levey on Jan. 1, 1974; No. 3,895,739 issued to Buchtel on July 22, 1975; No. 4,168,550 issued to Lindauer on Sept. 25, 1979; No. 4,171,546 issued to Dirksing on Oct. 23, 1979; No. 4,186,856 issued to Dirksing on Feb. 5, 1980; No. 4,216,027 issued to Wages on Aug. 5, 1980; No. 4,281,421 issued to Nyquist, Kitko & Stradling on Aug. 4, 1981; No. 4,305,162 issued to Cornelisse, Callicott & Brunsman on Dec. 15, 1981; No. 4,307,474 issued to Choy on Dec. 29, 1981; No. 4,357,718 issued to Corsette on Nov. 9, 1982; No. 4,370,763 issued to Dolan on Feb. 1, 1983; No. 4,375,109 issued to Jones on Mar. 1, 1983; No. 4,419,771 issued to Richards on Dec. 13, 1983; and No. 4,308,625 issued to Kitko on Jan. 5, 1982.

Passive dosing dispensers similar to those of the present invention are disclosed in commonly assigned U.S. Pat. No. 4,208,747 issued to Robert S. Dirksing on June 24, 1980 and entitled PASSIVE DOSING DISPENSER EMPLOYING TRAPPED AIR BUBBLE TO PROVIDE AIR-LOCK, which is hereby incorporated herein by reference. The dispensers of Dirksing '747 provide a means for trapping an air bubble as the dispenser is filled with tank water. The bubble later repositions itself to form an air-lock capable of isolating the solid product and liquid product solution in the dispenser from surrounding toilet tank water during quiescent periods. Without such isolation, active ingredient continually migrates by diffusion from the dispenser into the surrounding toilet tank water.

Such a product dispensing system is well adapted to a consumer product which may be used to dispense active ingredients such as hypochlorite solution to condition toilet tank and bowl water. The absence of any moving parts in the dispenser makes it possible to produce such a dispenser very inexpensively, such as by thermoforming two thin plastic halves and sealing them together. Such a dispenser may be made so economically that it is well adapted for use as a disposable dispenser which may be discarded after the active ingredients sealed therein are depleted.

SUMMARY OF THE INVENTION

It is an object of the present invention to provide a passive dosing dispenser which issues a dose of additive solution to a water tank of a toilet in response to the toilet being flushed.

It is a further object of the present invention to provide such a toilet tank dispenser in which an internally-generated gas bubble is utilized to provide or help provide a gas-lock between the solution in the dispenser and the toilet tank water.

It is a still further object of the present invention to provide such a toilet tank dispenser which efficiently captures internally-generated gas bubbles to form or help form such a gas-lock.

A passive dosing dispenser contains a solution which is to be isolated from a body of liquid when the dispenser is at least partially immersed therein. The dispenser is adapted to have a dose of the solution issue from the dispenser in response to the level of the body of liquid being lowered from a first elevation to a second elevation and to take liquid into the dispenser as the level of the body of liquid rises from the second elevation to the first elevation. The dispenser comprises the following:

(a) An internal reservoir contains a product which is soluble in the liquid to form the solution. The internal reservoir is adapted, in use, to contain a quantity of the solution.

(b) An inlet/discharge passageway, in use, provides fluid communication between the reservoir and the body of liquid. The inlet/discharge passageway has a reservoir-side opening and an intermediate, inverted, generally u-shaped section the legs of which extend to elevations below that of its central portion. The inlet/discharge passageway is designed such that, in use, immediately after cessation of the flow of liquid into the reservoir, a continuum of liquid/solution bridges the inverted, generally u-shaped section of the inlet/discharge passageway.

(c) Gas generating means provides gas bubbles in the dispenser during use.

(d) Passive means direct at least a portion of the gas bubbles in the dispenser in use to the inverted, generally u-shaped section of the inlet/discharge passageway to establish a gas-lock thereacross.

DETAILED DESCRIPTION OF THE INVENTION

Figure 1:
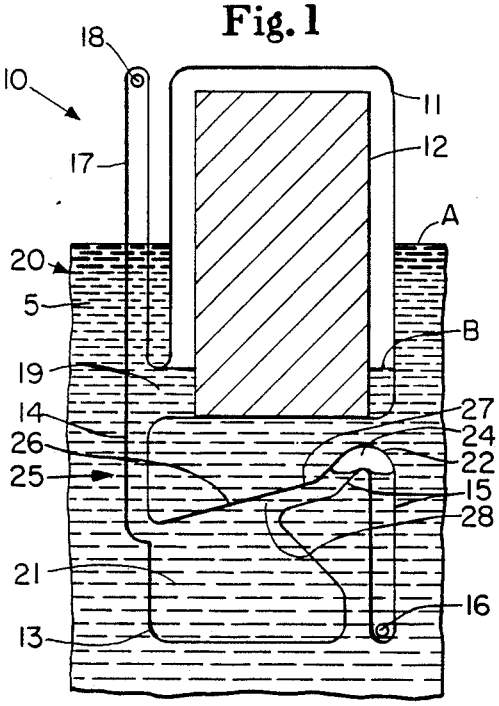
FIG. 1 is a schematic, sectional elevation view of a passive dosing dispenser of the present invention in use.

The present invention differs from dispensers such as those disclosed in Dirksing '747 cited hereinbefore in that isolation of the solution in the dispenser from the toilet tank water is not achieved immediately by means of an air-lock which is formed by repositioning of an air bubble which is trapped as the dispenser is filled with tank water. Instead, dispensers of the present invention utilize internally-generated gas bubbles to form or complete the formation of (i.e. establish) a gas-lock which isolates the solution in the dispenser from the toilet tank water. These internally generated gas bubbles can be from any source; however, they are preferably generated by the additive solution in the dispenser.

Solid cakes containing active ingredients for toilet tank dispensers are known. For dispensers which provide a disinfectant bleach, cakes which provide hypochlorite ion to the active solution are preferred. Such hypochlorite dispensing systems commonly contain solid cakes having one of two solid sources of hypochlorite ion: calcium hypochlorite or trichloroisocyanurate (TCCA).

Calcium hypochlorite is somewhat soluble water and dissolves from a cake containing it to provide hypochlorite ion in solution according to reaction (1):

$$\underset{\text{calcium hypochlorite}}{Ca(OCl)_2} \xrightarrow{H_2O} Ca^{++} + \underset{\text{hypochlorite ion}}{2\,OCl^-} \qquad (1)$$

A typical calcium hypochlorite cake also contains a base, such as calcium hydroxide, so that the active ingredient solution in a dispenser containing such a cake has a pH of about 10–11.

TCCA (or trichloro-s-triazinetrione) is produced by reacting cyanuric acid with chlorine gas in basic solution. TCCA is a solid which is somewhat soluble in water. In solution, TCCA reacts with water to produce hypochlorite ion Either 1, 2, or 3 of the chlorine constituents on the TCCA molecule can react with water to form hypochlorite as shown in reaction (2):

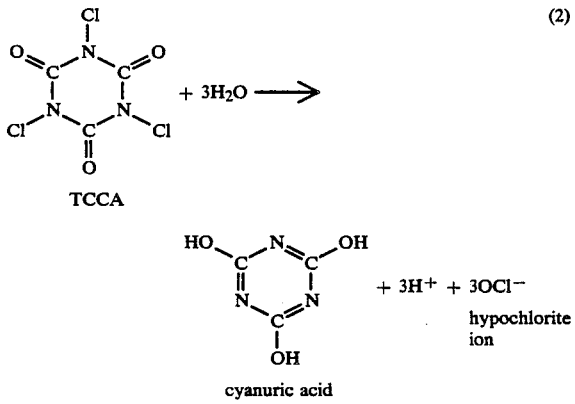

(2)

This reaction generates hydrogen ion, and a typical active ingredient solution in a dispenser containing TCCA cake has a pH of about 2–3.

Hypochlorite ion in solution is in equilibrium with hypochlorous acid, as shown in reaction (3), regardless of how the hypochlorite ion is formed, e.g. by reaction (1) or (2):

$$\underset{\text{hypochlorite ion}}{OCl^-} + H^+ \rightleftharpoons \underset{\text{hypochlorus acid}}{HOCl} \qquad (3)$$

Hypochlorous acid is somewhat unstable in aqueous solution and will slowly decompose to form chlorine gas, as shown in reaction (4):

$$\underset{\text{hypochlorous acid}}{2\,HOCl} + 2\,H^+ \longrightarrow \underset{\text{chlorine gas}}{Cl_2\uparrow} + 2\,H_2O \qquad (4)$$

The reaction in (4) occurs much more rapidly in acidic solution than it does in basic solution. Because of its typically lower pH, a toilet tank dispenser containing TCCA cake is generally capable of producing chlorine gas much more rapidly than one containing calcium hypochlorite cake.

A schematic, sectional elevation view of a preferred dispenser 10 of the present invention is shown in FIG. 1. Such a dispenser can be produced from two thin thermoformed plastic halves which are sealed together by any conventional means, such as heat sealing, radiation sealing, or adhesive sealing. The passageways and cavities of such dispensers can be produced with differing depths in order to provide the desired volume for each cavity or passageway. Portions of such passageways and cavities provide internal reservoir 25 which contains a product which is soluble in the liquid 5 of body of liquid 20 to form solution 21 and which is adapted, in use, to contain a quantity of solution 21.

Dispenser 10 comprises first cavity 11 which contains solid cake of disinfectant 12. Dispenser 10 also comprises second cavity 13, and third passageway 14 between first (cake) cavity 11 and second cavity 13. First (inlet/discharge) passageway 15 provides fluid communication between internal reservoir 25 and body of liquid 20 outside dispenser 10 through inlet/discharge hole 16 when dispenser 10 is in use. Second (vent) passageway 17 provides, in use, fluid communication between internal reservoir 25 and external medium (either air as shown in FIG. 1 or body of liquid 20, depending on whether dispenser 10 is partially or entirely immersed in body of liquid 20) and provides an air vent for dispenser 10 through vent hole 18. Solution 21 is contained in dispenser 10 in internal reservoir 25 which includes second cavity 13, at least a portion of first passageway 15, third passageway 14, the lower portion of first cavity 11 up to level B, and the lower portion of second passageway 17 up to elevation A. First passageway 15 has a reservoir-side opening 28 and an intermediate, inverted, generally u-shaped section 22 the legs of which extend to elevation below that of its central portion. Vent hole 18 and second (vent) passageway 17 provide means for air to enter dispenser 10 to replace solution 21 when it is discharged from dispenser 10 through inlet/discharge hole 16, and means for air to exit dispenser 10 when liquid 5 enters dispenser 10 through inlet/discharge hole 16. Vent hole 18 is preferably above the level of body of liquid 20 throughout the flush cycle.

The operation of dispenser 10 during a cycle when body of liquid 20 is lowered from a first elevation A to a second elevation C and is then raised to elevation A again is illustrated by the sequence of FIGS. 1–4. Dispenser 10 is at least partially immersed in body of liquid 20. Body of liquid 20 is typically the water in a water tank of a toilet. In FIG. 1, body of liquid 20 is at a level of first elevation A which is the normal level of the toilet tank water during quiescent periods. Dispenser 10 is preferably immersed in body of liquid 20 such that first elevation A is between vent hole 18 and level B which is the highest point of opening 19 between first (cake) cavity 11 and second (vent) passageway 17.

Figure 2:
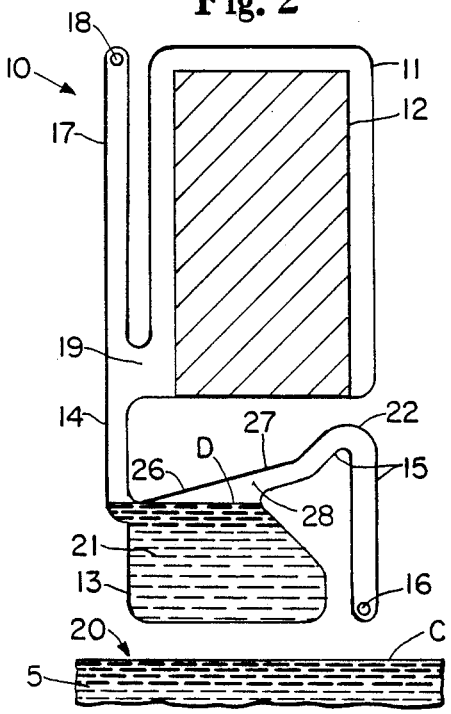
FIGS. 2, 3, and 4 are schematic, sectional elevation views of the dispenser shown in FIG. 1 at various times during a dispensing/filling cycle.

In FIG. 2, the level of body of liquid 20 has been lowered from first elevation A to second elevation C which is preferably below inlet/discharge hole 16. Such a lowering of the level of body of liquid 20 occurs in the water tank of a toilet when the toilet is flushed. Upon the lowering of the level of body of liquid 20, solution 21 in dispenser 10 flows through first passageway 15 and out inlet/discharge hole 16 into body of liquid 20. Such flow of solution 21 continues until the level of solution 21 in dispenser 10 approximately reaches level D. As solution 21 flows from dispenser 10 and its level drops, air enters dispenser 10 through vent hole 18 and replaces the portion of solution 21 discharged. When the level of solution 21 in dispenser 10 approximately reaches level D, air flows from third passageway 14 into first passageway 15 and the flow of solution 21 from dispenser 10 substantially ceases.

Figure 3:
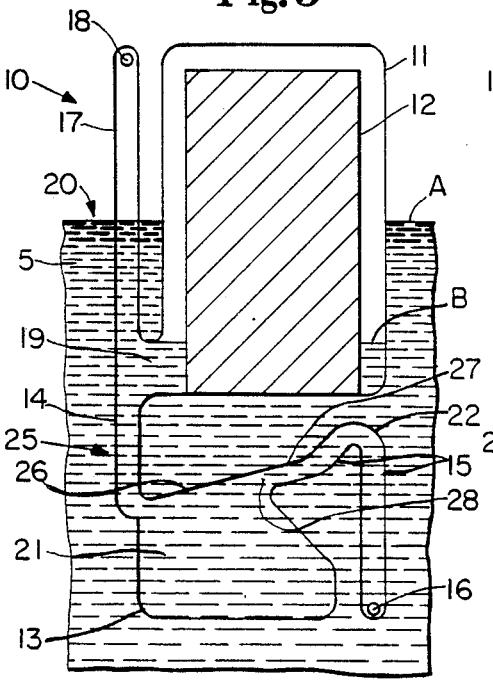
Figure 4:
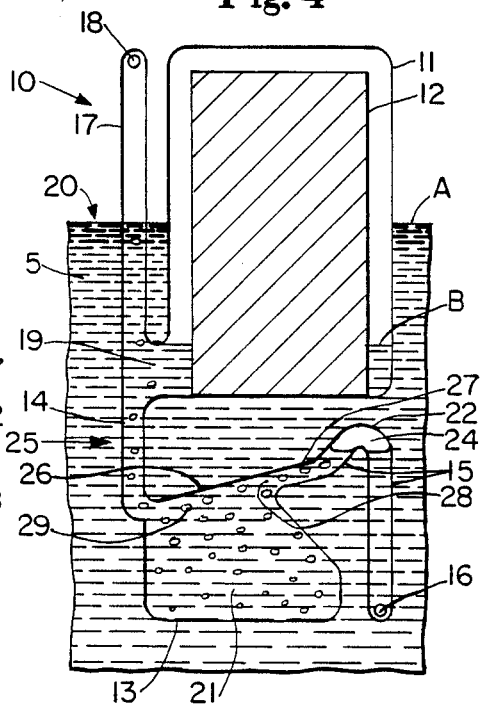

When the level of body of liquid 20 rises from second elevation C back to first elevation A (at the end of the flush cycle of the toilet), liquid 5 from body of liquid 20 flows into dispenser 10 through inlet/discharge hole 16 and through first passageway 15. Air is forced out of dispenser 10 through vent hole 18 as liquid 5 enters through hole 16. The incoming liquid 5 enters second cavity 13 and mixes with the portion of solution 21 which remains in second cavity 13. (The portion of solution 21 which remains in second cavity 13 throughout the flush cycle insures that some active ingredient will be available in solution 21 if another flush occurs immediately.) The liquid level in dispenser 10 rises until first passageway 15, second cavity 13 and third passageway 14 are completely filled with liquid/solution, as shown in FIG. 3, and until first cavity 11 fills to the upper level of opening 19 (level B) between first cavity 11 and second passageway 17. Second passageway 17 fills to about the same level as first elevation A of body of liquid 20. The level of liquid/solution in dispenser 10 does not rise substantially above level B in first cavity 11 because of air trapped in the upper portion of first cavity 11. First passageway 15 is configured such that, in use, immediately after cessation of the flow of liquid 5 into internal reservoir 25, a continuum of liquid/solution bridges inverted, generally u-shaped section 22.

For preferred dispenser 10, cake 12 is a solid which provides hypochlorite ion for solution 21. The portion of cake 12 below level B is immersed in solution when body of liquid 20 is at elevation A. Immediately after a flush cycle, solution 21 has been diluted with liquid 5. A portion of cake 12 dissolves in the diluted solution until solution 21 is saturated with the soluble ingredients of cake 12. As the lower portion of cake 12 dissolves, it slowly lowers in first cavity 11 making new portions of cake 12 available for dissolution in solution 21. Hypochlorite dissolved from cake 12 disperses throughout connecting portions of solution 21 in internal reservoir 25 of dispenser 10. Hypochlorite disperses in solution 21 by diffusion and because of differential specific gravity. Concentrated hypochlorite solution formed around cake 12 has a higher specific gravity than more dilute solution elsewhere in internal reservoir 25. Such concentrated solution tends to flow downward in dispenser 10 through third passageway 14 into second cavity 13.

Dispensers of the present invention have a passive means for providing a first gas-lock in the inlet/discharge (first) passageway when the dispenser is in use. For preferred dispenser 10, such first gas-lock means is inverted, generally u-shaped section 22 of first passageway 15. First passageway 15 is of such configuration that it either does not trap a bubble of air as liquid 5 flows into dispenser 10 or the bubble of air which is trapped is not of sufficient size to reposition and form an air-lock in first passageway 15 immediately after dispenser 10 is filled.

Dispensers of the present invention have a gas generating means for providing gas bubbles in the dispenser during use. Many chemical reactants can be incorporated in dispensers of the present invention as gas generating means, e.g. bicarbonates and acid, peroxides, carbides, borohydrides, etc. The gas generating reactions of such constituents are preferably controlled such that gas is slowly generated over the entire period of use of the dispenser. Physically entrapped gases which are slowly released during the period of use of the dispenser can be incorporated in dispensers of the present invention as gas generating means.

The gas generating means preferred for dispensers of the present invention is an active ingredient solution which provides gas bubbles for the gas-lock means. For preferred dispenser 10, solution 21 contains hypochlorite ions, and the gas generating means is solution 21 in which a chemical reaction occurs which produces chlorine gas bubbles. The hypochlorite in solution 21 partially decomposes with time according to reactions (3) and (4) hereinabove to form the chlorine gas. In time, a sufficient quantity of these gas bubbles collect in the gas-lock means (inverted, generally u-shaped section 22 of first passageway 15) to establish gas-lock 24 which isolates solution 21 in dispenser 10 from body of liquid 20.

Dispensers of the present invention have passive means for directing a sufficient portion of the gas bubbles from the gas generating means to the gas-lock means of the inlet/discharge passageway to form or complete the formation of a gas-lock thereacross, when the dispenser is in use. Such passive means for directing gas bubbles preferably comprises a generally transversely extending surface located above at least a portion of the volume of the internal reservoir and in a position to intercept at least a portion of the gas bubbles from the gas generating means. For dispenser 10, the means for directing chlorine gas bubbles 29 to gas-lock 24 comprises generally transversely extending surface 26 which is located above second cavity 13 (a portion of reservoir 25) and in a position to intercept at least a portion of gas bubbles 29. Transversely extending surface 26 is preferably inclined upwardly toward and is preferably contiguous with reservoir-side opening 28 of inlet/discharge passage 15. Transversely extending surface 26 preferably comprises an upwardly inclined portion 27 of inlet/discharge (first) passageway 15 leading to inverted, generally u-shaped section 22 of first passageway 15. Gas bubbles 29 from solution 21 in second cavity 13 are thus directed toward the gas-lock means, inverted generally u-shaped section 22, of first passageway 15.

The amount of time required to form or complete the formation of gas-lock 24 in inverted, generally u-shaped section 22 of inlet/discharge passageway 15 depends on several factors including the amount of air, if any, which is trapped in inlet/discharge passageway 15 during recharging, the rate of gas generation of the gas generating means and the portion of gas bubbles 29 which are directed to gas-lock means 22. In order to ensure that gas-lock 24 forms within a reasonable time period when solution 21 is the gas generating means, it is preferable that, in use, transversely extending surface 26 overlies at least about 1 cc of solution 21, more preferably at least about 2 cc of solution 21, more preferably still at least about 5 cc of solution 21.

Dispensers of the present invention can be immersed in the water of a toilet tank such that the vent hole is immersed when body of liquid 20 is at the level of first elevation A. For such toilet tank dispensers which have immersed vent holes, it is preferred that there be a passive means for providing a second gas-lock in the vent (second) passageway.

Figure 5:
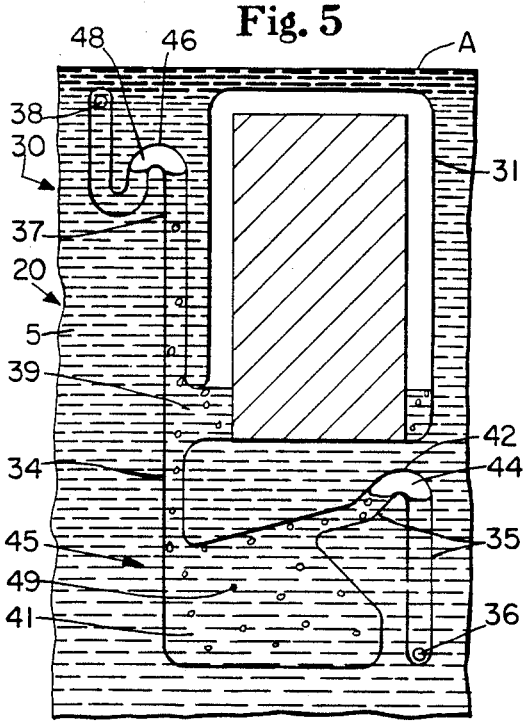
FIGS. 5, 6, 7, 8, 9, and 10 are schematic, sectional elevation views of alternative passive dosing dispensers of the present invention in use.

FIG. 5 is a schematic, sectional elevation view of dispenser 30 which is similar in design to dispenser 10 of FIGS. 1–4 and operates substantially in the same manner as dispenser 10. Gas-lock 44 forms in inverted, generally u-shaped section 42 of inlet/discharge (first) passageway 35 in the same manner as gas-lock 24 forms in first passageway 15 of dispenser 10. However, dispenser 30 is designed such that a gas-lock can be achieved in vent (second) passageway 37 when vent hole 38 is immersed in body of liquid 20 with body of liquid 20 at first elevation A. In use, second passageway 37 provides fluid communication between internal reservoir 45 which contains solution 41 and external medium through vent hole 38 for air to enter and exit dispenser 30. Second passageway 37 has inverted, generally u-shaped section 46 the legs of which extend to elevations below that of its central portion, for providing second gas-lock 48 in second passageway 37.

Immediately after body of liquid 20 rises to the level of elevation A at the end of a flush cycle and cessation of flow of liquid 5 into internal reservoir 45 through inlet/discharge hole 36, a continuum of liquid/solution bridges inverted, generally u-shaped section 46 of vent passageway 37. The portion of gas bubbles 49 generated in dispenser 30 in sections of internal reservoir 45 such as third passageway 34, cake cavity 31, and second passageway 37 rise into second passageway 37 and gather in inverted, generally u-shaped section 46 of vent passageway 37. Gas bubbles 49 generated in the lower portion of cake cavity 31 tend to rise into the upper portion of cavity 31 which is gas filled. This causes a corresponding amount of gas to be forced through opening 39 into second passageway 37. When sufficient gas has gathered in inverted, generally u-shaped section 46, gas-lock 48 is formed, thus isolating solution 41 from body of liquid 20 which were in contact through vent hole 38.

Figure 6:
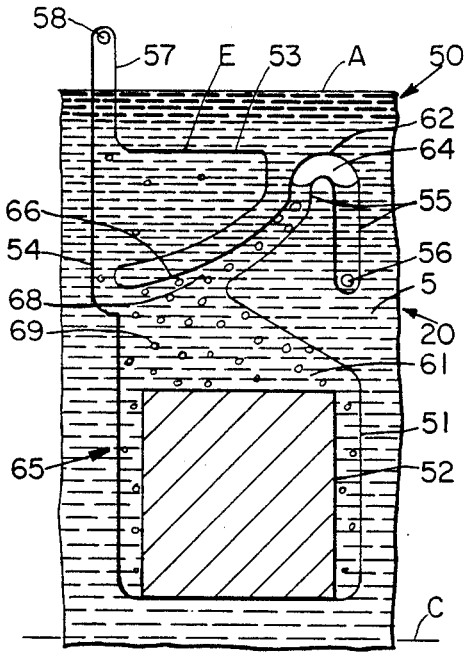

FIG. 6 is a schematic, sectional elevation view of another exemplary dispenser of the present invention. Dispenser 50 is preferably immersed in body of liquid 20 such that first elevation A (the level of body of liquid 20 during quiescent periods) is between vent hole 58 and level E which is the upper edge of second cavity 53. In dispenser 50, cake 52 in cake (first) cavity 51 is totally immersed in solution 61 at all times during a flush cycle and preferably comprises a material which slowly dissolves in water to provide hypochlorite ion to solution 61 which is contained in internal reservoir 65. When the level of body of liquid 20 drops from first elevation A to second elevation C, the level of solution 61 in dispenser 50 drops from approximately the level of elevation A to approximately the level of inlet/discharge hole 56.

Immediately after a flush cycle and the cessation of the flow of liquid 5 of body of liquid 20 into reservoir 65, a continuum of liquid/solution bridges inverted, generally u-shaped section 62 of inlet/discharge (first) passageway 55. During quiescent periods when the level of body of liquid 20 is at elevation A, gas bubbles 69 generated in cake cavity 51 are directed into reservoir-side opening 68 of first passageway 55 by inclined, transversely extending surface 66. Such gas bubbles 69 rise through first passageway 55 to gas-lock means (inverted generally u-shaped section) 62 of first passageway 55 where gas-lock 64 is established, thus isolating solution 61 from body of liquid 20 which were in contact through inlet/discharge hole 56. Gas bubbles 69 generated in second cavity 53 or third passageway 54 rise through solution 61 to second passageway 57 and escape from dispenser 50 through vent hole 58.

Figure 7:
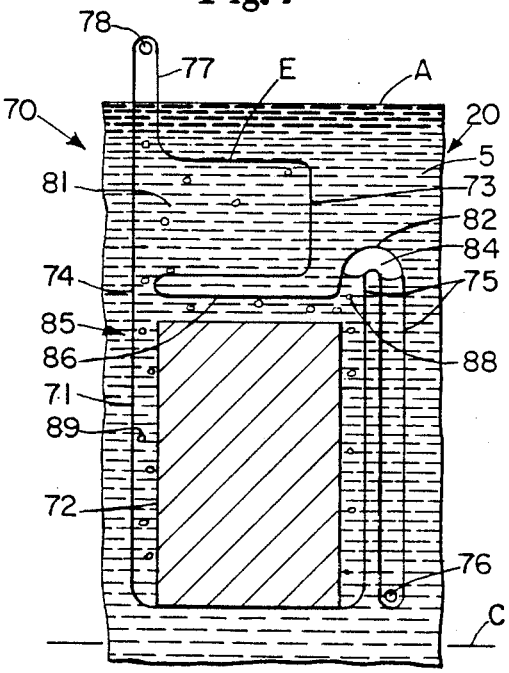

FIG. 7 is a schematic, sectional elevation view of another exemplary dispenser of the present invention which functions in a manner very similar to dispenser 50 of FIG. 6. Dispenser 70 is preferably immersed in body of liquid 20 such that first elevation A (the level of body of liquid 20 during quiescent periods) is between vent hole 78 and level E, the upper edge of second cavity 73. Cake 72 in first cavity 71 is preferably a material which slowly dissolves in water to provide hypochlorite ion to solution 81 which is contained in internal reservoir 85. When the level of body of liquid 20 drops from first elevation A to second elevation C, which is preferably below the level of third passageway 74, the level of solution 81 in dispenser 70 drops from approximately the level of first elevation A to approximately the level of reservoir-side opening 88 of first passageway 75. Air which enters dispenser 70 through vent hole 78 to replace discharged solution 81 flows from third passageway 74 along transverse surface 86 and into reservoir-side opening 88 of first passageway 75 and the flow of solution 81 into body of liquid 20 substantially ceases. Later, as the level of body of liquid 20 rises to first elevation A, liquid 5 is admitted to internal reservoir 85 through inlet/discharge hole 76 and first passageway 75.

Immediately after a flush cycle and the cessation of the flow of liquid 5 into reservoir 85, a continuum of liquid/ solution bridges inverted, generally u-shaped section 82 of inlet/discharge (first) passageway 75. During quiescent periods when the level of body of liquid 20 is at first elevation A, gas bubbles 89 generated in first cavity 71 rise through solution 81 to horizontal, transverse surface 86 which is contiguous with reservoir-side opening 88 of inlet/discharge passageway 75. Gas bubbles 89 collect and coalesce along horizontal transverse surface 86 and eventually move either into third passageway 74 or into first passageway 75. Bubbles 89 which move into first passageway 75 collect in gas-lock means (inverted, generally u-shaped section) 82 of first passageway 75 and establish gas-lock 84 which isolates solution 81 in dispenser 70 from body of liquid 20. Bubbles 89 which move into third passageway 74 rise through solution 81 into second passageway 77 and out vent hole 78.

Figure 8:
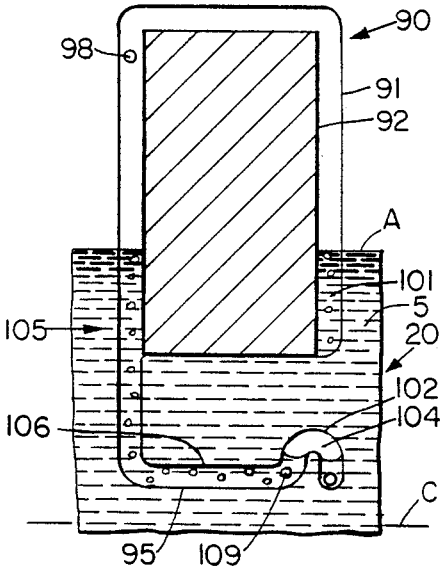

FIG. 8 is a schematic, sectional elevation view of another exemplary dispenser of the present invention. Dispenser 90 is preferably immersed in body of liquid 20 such that a portion of first cavity 91 containing cake 92 is below the level of first elevation A of body of liquid 20 (the level of body of liquid 20 during quiescent periods). Vent hole 98 is preferably above first elevation A. Cake 92 preferably dissolves slowly in water to provide hypochlorite ion to solution 101 which is contained in internal reservoir 105. When the level of body of liquid 20 drops from first elevation A to second elevation C, which is preferably below the level of first (inlet/discharge) passageway 95, solution 101 flows from internal reservoir 105 of dispenser 90 into body of liquid 20. The level of solution 101 in dispenser 90 drops from approximately the level of first elevation A to approximately the level of horizontal, transversely extending surface 106. Later, as the level of body of liquid 20 rises to first elevation A, liquid 5 from body of liquid 20 is admitted to reservoir 105 through passageway 95.

Immediately after a flush cycle and the cessation of the flow of liquid 5 into reservoir 105, a continuum of liquid/solution bridges inverted, generally u-shaped section 102 of inlet/discharge (first) passageway 95. During quiescent periods when body of liquid 20 is at first elevation A, gas bubbles 109 generated in first passageway 95 collect and coalesce along horizontal transverse surface 106. Such bubbles eventually move either up first passageway 95 into first cavity 91 and out vent hole 98, or into gas-lock means (inverted, generally u-shaped section) 102 which is a passive means for providing gas-lock 104 in first passageway 95. Gas bubbles 109 generated in first cavity 91 pass from dispenser 90 through vent hole 98.

Because the volume of first passageway 95 of dispenser 90 is generally small, it can take a long period of time for solution 101 in first passageway 95 to generate sufficient gas bubbles 109 to establish gas-lock 104. This will, of course, depend on the rate of gas generation of solution 101.

Figure 9:
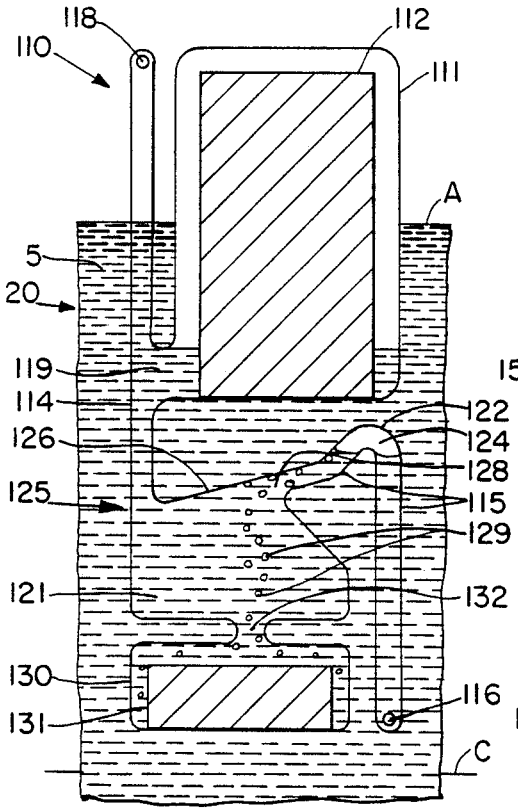

FIG. 9 is a schematic, sectional elevation view of another exemplary dispenser of the present invention. Dispenser 110 is preferably immersed in body of liquid 20 such that first elevation A (the level of body of liquid 20 during quiescent periods) is between vent hole 118 and the top of opening 119. Cake 112 in first cavity 111 is preferably a material which slowly dissolves in water to provide the cleansing, disinfecting, or other action desired of solution 121 which is contained in internal reservoir 125. When the level of body of liquid 20 drops from first elevation A to second elevation C, the level of solution 121 in dispenser 110 drops from approximately the level of first elevation A to approximately the level of reservoir-side opening 128 of first passageway 115. Air which enters dispenser 110 through vent hole 118 to replace discharged solution 121 flows from third passageway 114 along transversely extending surface 126 and into reservoir-side opening 128 of passageway 115 and the flow of solution 121 into body of liquid 20 substantially ceases. Later, as the level of body of liquid 20 rises to first elevation A, liquid 5 is admitted to internal reservoir 125 through inlet/discharge hole 116 and first passageway 115.

Immediately after a flush cycle and the cessation of the flow of liquid 5 into reservoir 125, a continuum of liquid/solution bridges inverted, generally u-shaped section 122 of inlet/discharge (first) passageway 115. Compartment 130 contains a gas generating means other than solution 121. Such gas generating means is typically a material, e.g. solid material 131 (which may be, for example, a bicarbonate, peroxide, carbide, borohydride, etc.), which reacts slowly with liquid 5 and/or solution 121 to form a gas and generate gas bubbles 129. Compartment 130 containing such a gas generating means preferably underlies at least a portion of reservoir 125. The passive means for directing gas bubbles 129 toward gas-lock means 122 of first passageway 125 includes aperture 132 intermediate compartment 130 and reservoir 125. Aperture 132 is preferably located directly beneath generally transversely extending surface 126 such that surface 126 intercepts gas bubbles 129 and directs them toward gas-lock means 122. Transversely extending surface 126 is preferably inclined upwardly toward reservoir-side opening 128 of inlet/discharge passageway 115. Bubbles 129 thus collect in gas-lock means (inverted, generally u-shaped section) 122 of first passageway 125 and establish gas-lock 124 which isolates solution 121 in dispenser 110 from body of liquid 20.

Figure 10:
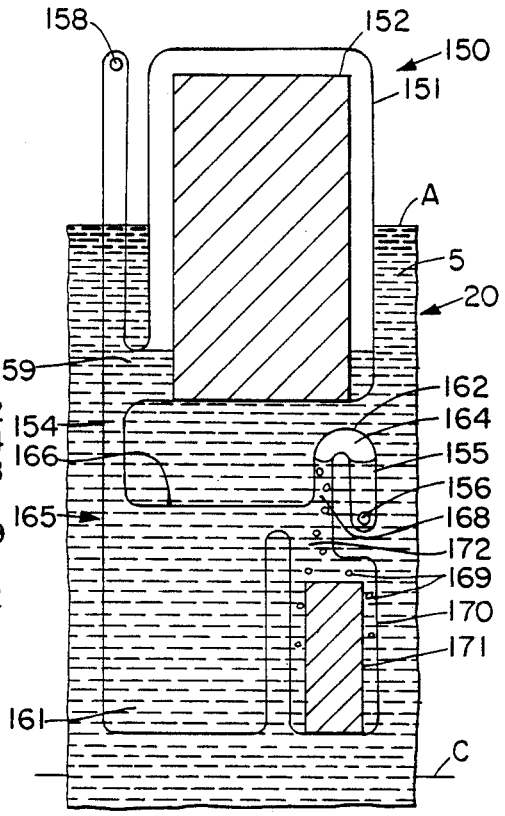

FIG. 10 is a schematic, sectional elevation view of another exemplary dispenser of the present invention which functions in a manner very similar to dispenser 110 of FIG. 9. Dispenser 150 is preferably immersed in body of liquid 20 such that first elevation A (the level of body of liquid 20 during quiescent periods) is between vent hole 158 and opening 159. Cake 152 in first cavity 151 is preferably a material which slowly dissolves in water to provide active ingredient to solution 161 which is contained in internal reservoir 165. When the level of body of liquid 20 drops from first elevation A to second elevation C, the level of solution 161 in dispenser 150 drops from approximately the level of first elevation A to approximately the level of reservoir-side opening 168 of first passageway 155. Air which enters dispenser 150 through vent hole 158 to replace discharged solution 161 flows from third passageway 154 along transversely extending surface 166 and into reservoir-side opening 168 of passageway 155 and the flow of solution 161 into body of liquid 20 substantially ceases. Later, as the level of body of liquid 20 rises to first elevation A, liquid 5 is admitted to internal reservoir 165 through inlet/discharge hole 156 and first passageway 155.

Immediately after a flush cycle and the cessation of the flow of liquid 5 into reservoir 165, a continuum of liquid/solution bridges inverted, generally u-shaped section 162 of inlet/discharge (first) passageway 155. Dispenser 150 has a gas generating means other than solution 161. The gas generating means is contained in compartment 170. The gas generating means preferably comprises solid material 171 (e.g. a bicarbonate, peroxide, carbide, borohydride, etc.) which reacts slowly with liquid 5 and/or solution 161 to generate gas and form gas bubbles 169. Gas bubbles 169 escape compartment 170 through aperture 172 between compartment 170 and reservoir 165. Aperture 172 is located immediately beneath reservoir-side opening 168 of first passageway 155 such that gas bubbles 169 are directed to gas-lock means 162. Gas bubbles 169 collect in gas-lock means (inverted, generally u-shaped section) 162 of first passageway 155 and establish gas-lock 164 which isolates solution 161 in dispenser 150 from body of liquid 20.

The exemplary dispensers depicted and described herein provide an indication of the wide variety of designs that can provide the desired functions of the dispenser. The preferred design is dependent on the gas generating means employed, particularly the rate of gas generation. It is preferred that dispensers of the present invention be designed such that, in any passageway which provides fluid communication between the solution in the dispenser and the external body of liquid, a gas-lock is established within about 50 hours, more preferably within about 20 hours, more preferably still within about 8 hours.

While particular embodiments of the invention have been illustrated and described, it would be obvious to those skilled in the art that various changes and modifications can be made without departing from the spirit and scope of the invention. It is intended to cover, in the appended claims, all such modifications that are within the scope of this invention.

What is claimed is:

1. A passive dosing dispenser for a solution which is to be isolated from a body of liquid when said dispenser is at least partially immersed therein and which is adapted to have a dose of said solution issue from said dispenser in response to the level of said body of liquid being lowered from a first elevation to a second elevation and to have liquid taken into said dispenser as the level of said body of liquid rises from said second elevation to said first elevation, said dispenser comprising:

(a) an internal reservoir for containing a product which is soluble in said liquid to form said solution and which is adapted, in use, to contain a quantity of said solution;

(b) an inlet/discharge passageway which is use provides fluid communication between said reservoir and said body of liquid, said inlet/discharge passageway having an intermediate, inverted, generally u-shaped section the legs of which extend to elevations sufficiently below that of its central portion to provide a syphon action during the terminal portion of issuing each said dose of said solution, said inlet/discharge passageway comprising means for providing, in use, immediately after cessation of the flow of liquid into the reservoir, a continuum of liquid/solution bridging the inverted, generally u-shaped section of said inlet/discharge passageway;

(c) gas generating means for providing gas bubbles in said dispenser during use; and (d) passive means for directing at least a portion of said gas bubbles in said dispenser in use to said inverted, generally u-shaped section of said inlet/-discharge passageway to establish a gas-lock thereacross.

2. The dispenser of claim 1 wherein said passive means for directing said gas bubbles comprises a generally transversely extending surface located above at least a portion of said reservoir and in a position to intercept at least a portion of said gas bubbles from said gas generating means.

3. The dispenser of claim 2 wherein the product is such that dissolution thereof in said liquid produces a solution which contains hypochlorite ions and wherein said gas generating means is said solution in which a chemical reaction occurs which produces chlorine gas.

4. The dispenser of claim 3 wherein said surface overlies at least about 1 cc of said solution in use.

5. The dispenser of claim 2 wherein at least a portion of said surface is inclined upwardly toward and said surface is contiguous said inlet/discharge passageway.

6. The dispenser of claim 5 wherein the product is such that dissolution thereof in said liquid produces a solution which contains hypochlorite ions and wherein said gas generating means is said solution in which a chemical reaction occurs which produces chlorine gas.

7. The dispenser of claim 2 wherein said transversely extending surface comprises an upwardly inclined portion of said inlet/discharge passageway leading to said inverted, generally u-shaped section of said inlet/discharge passageway.

8. The dispenser of claim 2 wherein said surface is horizontal and is contiguous the reservoir-side opening of said inlet/discharge passageway.

9. The dispenser of claim 8 wherein said product is such that dissolution thereof in said liquid produces a solution which contains hypochlorite ions and wherein said gas generating means is said solution in which a chemical reaction occurs which produces chlorine gas.

10. The dispenser of claim 9 wherein said surface overlies at least about 1 cc of said solution in use.

11. The dispenser of claim 1 wherein said gas generating means is located in a compartment underlying at least a portion of said reservoir and wherein said passive means for directing said gas bubbles comprises an aperture intermediate said compartment and said reservoir.

12. The dispenser of claim 11, wherein said aperture is located directly beneath the reservoir-side opening of said inlet/discharge passageway.

13. The dispenser of claim 11, wherein said passive means for directing said gas bubbles also comprises a generally transversely extending surface located above said aperture in a position to direct said gas bubbles into the reservoir-side opening of said inlet/discharge passageway.

14. The dispenser of claim 13, wherein at least a portion of said surface is inclined upwardly toward the reservoir-side opening of said inlet/discharge passageway.

15. The dispenser of claim 1, wherein said dispenser also comprises:

(e) a vent passsageway which in use provides fluid communication between said reservoir and external medium, said vent passageway having an intermediate, inverted, generally u-shaped section the legs of which extend to elevations below that of its central portion, said vent passageway being designed such that, in use, immediately after cessation of the flow of liquid into the reservoir, a continuum of liquid/solution bridges the inverted, generally u-shaped section of said vent passageway; and (f) passive means for directing at least a portion of said gas bubbles in said solution in use to said inverted, generally u-shaped section of said vent passageway to establish a gas-lock thereacross.

* * * * *

UNITED STATES PATENT AND TRADEMARK OFFICE

CERTIFICATE OF CORRECTION

PATENT NO. : 4,937,893

DATED : July 3, 1990

INVENTOR(S) : S. H. IDING AND R. S. DIRKSING

It is certified that error appears in the above-identified patent and that said Letters Patent is hereby corrected as shown below:

Column 3, line 19, after "soluble" insert -- in -- .

Column 3, line 36, after "ion" insert a period -- . --

Column 11, line 23, "is" should read -- in -- .

Column 12, line 3, after "contiguous" insert -- with the reservoir-side opening of -- .

Signed and Sealed this

Seventh Day of July, 1992

*Attest:*

DOUGLAS B. COMER

*Attesting Officer*

*Acting Commissioner of Patents and Trademarks*